United States Patent [19]

Tanaka et al.

[11] Patent Number: 4,742,043

[45] Date of Patent: May 3, 1988

[54] HEAT-SENSITIVE RECORDING MATERIAL

[75] Inventors: Toshiharu Tanaka; Toshimasa Usami, both of Shizuoka, Japan

[73] Assignee: Fuji Photo Film Co., Ltd., Kanagawa, Japan

[21] Appl. No.: 824,346

[22] Filed: Jan. 23, 1986

[30] Foreign Application Priority Data

Jan. 23, 1985 [JP] Japan ..... 60-10270

[51] Int. Cl.[4] ..... B41M 5/18

[52] U.S. Cl. ..... 503/213; 427/150; 427/151; 428/402.21; 428/402.22; 503/215; 503/216; 503/217; 503/221; 503/224

[58] Field of Search ..... 346/214, 215; 427/150–152; 428/402.21, 402.22; 503/213–217, 221, 224

[56] References Cited

U.S. PATENT DOCUMENTS 4,439,581 3/1984 Irii et al. ..... 524/839
4,529,681 7/1985 Usami et al. ..... 430/138
4,598,035 7/1986 Usami et al. ..... 430/138

FOREIGN PATENT DOCUMENTS 2160671A 12/1985 United Kingdom ..... 346/215
2160992A 1/1986 United Kingdom ..... 346/215

*Primary Examiner*—Bruce H. Hess
*Attorney, Agent, or Firm*—Sughrue, Mion, Zinn, Macpeak, and Seas

[57] ABSTRACT

A heat-sensitive recording material is disclosed, comprising a support and heat-sensitive recording layer on the support, said layer containing (1) microcapsules containing a basic dye precursor and an organic solvent as the core thereof and (2) a developer capable of forming color on reacting with the basic dye precursor, wherein said microcapsules are produced by the use of a wall-forming substance comprising xylylene diisocyanate or an adduct thereof such that the microcapsule walls are impermeable to both the basic dye precursor and developer at room temperature, but at a temperature of a thermal head during a recording process, become permeable to at least one of the basic dye precursor and developer, thereby permitting formation of a colored image as a result of the reaction between the basic dye precursor and the developer. This material can retain its excellent recording ability for a long period of time; that is, it possesses excellent storage stability, and moreover can produce a recorded image of high storage stability.

25 Claims, No Drawings

HEAT-SENSITIVE RECORDING MATERIAL

BACKGROUND OF THE INVENTION

The present invention relates to a heat-sensitive recording material, particularly to a heat-sensitive recording material that can retain its excellent recording ability for a long period of time and can produce recorded matter having excellent stability. More specifically, the present invention relates to a heat-sensitive recording material which is excellent in color-forming properties upon application of heat, and which can produce recorded matter in which the whiteness of an unprinted area is high; that is, a printed image of high contrast.

Heat-sensitive recording methods typically utilize a recording material as prepared by mixing a basic dye precursor, an acidic substance and a low melting compound in a particle form as the color-forming components and coating the resulting mixture on a support, in which upon application of heat the particles melt, thereby forming color. Such recording materials, however, have a disadvantage in that when it is handled under severe conditions after recording or contacted with an adhesive tape or a diazo copying paper, decoloration or coloration undesirably occurs.

In recent years, to overcome the above problem, an improved heat-sensitive recording material has been developed in which one of the color-forming components is encapsulated.

U.S. Pat. No. 4,529,681, for example, discloses a light-sensitive, heat-sensitive recording material in which microcapsules containing a photopolymerizable vinyl compound, a photopolymerization initiator, and one of the components causing color formation, and the other color-forming component are coated on the same surface of a support. When the above recording material is heated, the color-forming component in the capsule permeates through the capsule wall, coming out of the capsule, or alternatively the other color-forming component outside the capsule permeates through the capsule wall, entering the inside of the capsule. This results in the formation of color. That is, upon application of heat, color is formed in heated areas. Thereafter, if the material is entirely exposed to light, the vinyl compound in the core of the capsule undergoes polymerization, thereby preventing the permeation of the color-forming compound through the capsule wall and thus preventing coloration of non-colored areas. This operation to prevent further coloration is usually called "fixing".

U.S. patent application Ser. No. 600,267 (filed on Apr. 13, 1984) discloses a material in which at least one of a diazo compound, a coupling component and an auxiliary color-forming agent is incorporated in the core of a microcapsules.

The above photo-fixable, heat-sensitive recording material utilizing microcapsules has advantages in that a recording apparatus can be simplified, the material can be stored for a long period of time while retaining its recording performance, and in that the stability of an image and its background after recording is excellent. However, on the other hand, it has disadvantages in that since at least one of color-forming components causing color formation is separated by the capsule walls, heat color-forming properties are reduced and at high-speed recording utilizing pulses of shorter width, coloration sometimes occurs only to an insufficient extent.

In an embodiment of U.S. Pat. No. 4,529,681, when a basic colorless dye is used as a color-forming component, it is essential for the composition of a core substance to have such properties as to undergo photopolymerization upon application of light and to harden. Even in the case of a core substance composition not having a photopolymerization capability, that is, a composition not containing a vinyl compound and photopolymerization initiator at the same time, the material is excellent in storage stability and also in the stability of recorded matter, such as a printed image, but the heat color-forming properties thereof are reduced, since the color-forming components are separated by the capsule walls before and after recording. In a case that a vinyl compound coexists, coloration of a basic dye precursor at the step of encapsulation does not almost occur. In the system of U.S. Pat. No. 4,529,681, however, if a heat-sensitive recording material not having fixing properties is intended to prepare without use of a vinyl compound, a problem arises in that coloration readily occurs at the step of encapsulation. If such colored microcapsules are used, a sheet prepared by coating the microcapsules has a disadvantage in that the whiteness is low.

SUMMARY OF THE INVENTION

An object of the present invention is to provide a heat-sensitive recording material containing a microencapsulated basic dye precursor which can produce a recorded image where the whiteness of unprinted areas is high.

Another object of the present invention is to provide a heat-sensitive recording material which is free from the formation of ground fogging and a reduction in color-forming properties over time, and which can produce a recorded image having excellent storage stability.

Still another object of the present invention is to provide a heat-sensitive recording material which is excellent in heat color-forming properties.

It has been found that the objects can be attained by preparing microcapsules using xylylene diisocyanate or an adduct thereof.

The present invention relates to a heat-sensitive recording material comprising a support and a heat-sensitive recording layer on the support, said layer containing (1) microcapsule containing a basic dye precursor and an organic solvent as the core thereof and (2) a developer capsule of forming color on reacting with the basic dye precursor, wherein said microcapsules are produced by the use of a wall-forming substance comprising xylylene diisocyanate or an adduct thereof such that the microcapsule walls are impermeable to both the basic dye precursor and developer at room temperature, but at a temperature of a thermal head during a recording process, become permeable to at least one of the basic dye precursor and developer, thereby permitting formation of a colored image as a result of the reaction between the basic dye precursor and the developer, thereby providing a colored image as a result of the reaction between the basic dye precursor and the developer.

DETAILED DESCRIPTION OF THE INVENTION

Microcapsules as used in conventional recording materials are broken by application of heat or pressure so as to bring a reactive substance contained in the microcapsule into contact with another reactive substance outside the microcapsule, thereby causing the reactive substances to react with each other while forming color. On the other hand, in microcapsules of the present invention, the color-forming reaction is caused by allowing the reactive substances present in the inside and outside of the microcapsule to pass through the capsule walls and come into contact with each other at the time of heating. It has been known that when microcapsule walls are produced by polymerization, they are not completely impermeable but having permeability. It is known that the above permeability of the microcapsule walls is ascribable to gradual permeation of low molecular weight substances through the walls over a long period of time. However, the phenomenon as in the present invention that permeation occurs instantaneously on heating has not been known. Thus it is not always required for the walls of microcapsules of the present invention to melt by heating; rather, it has been found that if the melting point of the microcapsule walls is high, the final recording material can retain its recording performance for a long period of time.

Even if the core substance of the microcapsule of the present invention is removed and the microcapsules are heated to the temperature at which the system of the present invention provides a colored image (i.e., 60° to 200° C.), no melting and softening the microcapsule walls are observed with a microscope.

Microcapsules prepared using a polyvalent isocyanate or an adduct thereof and a pressure-sensitive recording paper utilizing such microcapsules are known, as described, for example, in British Pat. No. 1,292,939. In such case, however, microcapsules for a pressure-sensitive recording paper, having such a high heat resistance that a core substance is not lost by permeation through the walls even when heated, are intended to be produced.

In the present invention, microcapsule walls are made using xylylene diisocyanate or an adduct thereof. The microcapsules of the present invention are impermeable before heating and, therefore, a heat-sensitive recording sheet using these microcapsules is free from the formation of fog with the passage of time. However, when heated, the capsule walls become permeable instantaneously, and thus the recording sheet is excellent in color-forming properties.

Usually, when a basic dye precursor is encapsulated as a core substance using polyvalent isocyanate or its adduct as a wall material, colored capsules are formed depending on the type of the dye. These colored capsules when used in a pressure-sensitive paper does not cause any problem because they are coated on the back of a paper support. In the case of a heat-sensitive recording sheet, however, since the colored capsules are coated on the surface of the paper support, the surface of the final recording sheet is colored, leading to a reduction in the commercial values of the article. On the contrary, the microcapsules of the present invention, prepared using xylylene diisocyanate or an adduct thereof as a wall material are never colored, and thus, when coated on the surface of a support, provide a heat-sensitive recording material having a high whiteness.

Microcapsules as used in the heat-sensitive recording material of the present invention are prepared by emulsifying a core substance and then forming walls of a polymer of xylylene diisocyanate or an adduct thereof on droplets of the core substance. A reactant forming the polymeric substance is added to the inside and/or the outside of the droplets. Representative examples of such polymeric substances are polyurethane, polyurea, and polyamide.

In preparation of microcapsule walls of the present invention, it is especially effective to employ the microcapsulation method utilizing polymerization of the reactant from the inside of the droplets. Such microcapsulation method permits preparation of capsules having a uniform particle size in a short period of time, and provides a recording material having excellent storage stability. Such method is described in detail in U.S. Pat. Nos. 3,726,804 and 3,796,669.

For example, when polyureapolyurethane is used in the preparation of capsule walls, xylylene diisocyanate or an adduct thereof and a second substance capable of forming capsule walls on reacting with the xylylene diisocyanate or an adduct thereof (e.g., a polyol or a polyamine) are emulsified in water or mixed with an oily liquid to be encapsulated and then emulsified in water, and then the temperature is increased, whereupon a polymerization reaction occurs in the interface of oil droplets, thereby forming microcapsule walls. At this stage, a low boiling auxiliary solvent having a high dissolving power may be added to the oily liquid. Even when the above second additive is not present, polyurea results.

The glass transition point of the microcapsule wall is preferably from 60° to 200° C. and mor preferably from 70° to 150° C. The capsule wall, when momentarily heated by the use of a thermal head, changes from a glass state to a rubber state, allowing the color-forming components to pass through the capsule wall and come into contact with each other, as a result of which a color-forming reaction occurs as described above.

Microscopic observation shows that mainly a reactive substance present outside the capsule permeates through the capsule walls and enter the inside of the capsule, and reacts with another reactive substance in the capsule, thereby producing a colored substance in the capsule.

The term "glass transition point of the capsule of the present invention" refers to a glass transition of the capsule walls in the system which is affected by the various substances in the system (such as water, plasticizer, etc.). Such glass transition point very closely relates to an inherent glass transition point of the capsule walls though there is some influence of the substances in the system. Therefore, in the present invention, the inherent glass transition point of the capsule walls is controlled thereby the glass transition point of the capsules in the system is controlled.

Controlling the inherent glass transition of the capsule wall can be achieved by suitably selecting the second wall-forming substance to react with xylylene diisocyanate or the adduct thereof as the polyvalent isocyanate. Also, by suitably selecting a compound to be added to xylylene diisocyanate in the preparation of the xylylene diisocyanate adduct, the glass transition point of the capsule wall can be controlled.

As the second wall-forming substance to form the capsule wall by reacting with xylylene diisocyanate or an adduct thereof as the first wall-forming substance, any of compounds having at least two equivalents of an active group to the isocyanate group, such as a polyvalent hydroxy compound, an epoxy compound, a polyvalent thiol compound, a polyvalent amine compound, an acid anhydride compound, and a polycarboxylic acid compound can be used.

As the wall-forming substance, the prepolymers of the above compounds may be used.

Typical examples of the polyvalent hydroxy compound are aliphatic and aromatic polyvalent alcohols, hydroxypolyesters, and hydroxypolyalkylene ethers. Representative examples are aromatic and aliphatic polyvalent alcohols such as catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxyethylbenzene, 1,3-naphthalenediol, 1,5-naphthalenediol, 2,7-naphthalenediol, 2,3-naphthalenediol, o,o'-biphenol, p,p'-biphenol, 1,1'-bi-2-naphthol, bisphenol A, 2,2'-bis(4-hydroxyphenyl)butane, 2,2'-bis(4-hydroxyphenyl)isopentane, 1,1'-(4-hydroxyphenyl)cyclopentane, 1,1'-bis(4-hydroxyphenyl)cyclohexane, 2,2'-bis(4-hydroxy-3-methylphenyl)propane, bis-(2-hydroxyphenyl)methane, xylylenediol, ethylene glycol, 1,3-propylene glycol, 1,4-butylene glycol, 1,5-pentanediol, 1,6-heptanediol, 1,7-heptanediol, 1,8-octanediol, 1,1,1-trimethylolpropane, hexanetriol, pentaerythritol, glycerine, and sorbitol, hydroxypolyesters as obtained from polyvalent carboxylic acids and polyvalent alcohols, and hydroxypolyalkylene ether as obtained by condensation of alkylene oxides and polyvalent alcohols.

Particularly useful hydroxypolyalkylene ethers are polyethers as obtained using alkylene oxides exhibiting high lipophilic properties and having from 3 to 6 carbon atoms, such as condensation products of polypropylene oxide or polybutylene oxide and glycol, glycerine, pentaerythritol or sorbitol.

Examples of the epoxy compound are aliphatic glycidyl ethers such as diglycidyl ether, glycerinetriglycidyl ether and polyallylglycidyl ether; aliphatic glycidyl esters such as diglycidyl ethers of linolein dimeric acid; and glycidyl ether/ester mixtures such as bisphenol A diglycidyl ether, trihydroxyphenylpropane triglycidyl ether, trihydroxyphenylpropane triglycidyl ether, and 4,4-bis(4-hydroxyphenyl)pentanoic acid diglycidyl ether ester.

Examples of the polyvalent thiol are thioglycol and condensates of thioglycol.

Examples of the polyvalent amine are aromatic polyamines such as o-phenylenediamine, p-phenylenediamine, 1,5-S-diaminonapthalene and phthalamide; and aliphatic polyamines such as N,N'-S-1,3-propylenediamine and N,N'-S-1,4-butylenediamine. Not only primary amines but also secondary amines can be used.

Examples of the acid anhydride are maleic anhydride, succinic anhydride, phthalic anhydride and benzoic anhydride.

Examples of the polycarboxylic acid compound are malonic acid, sauccinic acid, glutaric acid, adipic acid, pimelic acid, maleic acid, isophthalic acid, terephthalic acid and gluconic acid.

The xylylene diisocyanate adduct as used as the first wall-forming substance is an adduct as prepared by adding xylylene diisocyanate to a compound having at least two equivalents of a group exhibiting activity to the isocyanate group as described above, in such a manner that the resulting adduct has at least two isocyanate groups in the molecule. The most preferred is an adduct of 3 mol of xylylene diisocyanate and 1 mol of trimethylolpropane.

The glass transition point of the capsule wall can be changed by adding urea compounds, fatty acid amides, organic sulfonamides, hydroxy compounds, carbamic acid esters, aromatic methoxy compounds, or the like in a solid dispersion state. The amount of the glass transition point-adjusting agent being added is suitably from 0.1 to 10 parts by weight per part by weight of the capsule.

In preparation of microcapsules, water-soluble polymers can be used as protective colloids. These water-soluble polymers include water-soluble anionic, nonionic and amphoteric polymers. As these anionic polymers, any of natural and synthetic polymers can be used. For example, polymers having a group —COO⁻ or a group —SO⁻ can be used. Representative examples of anionic natural polymers are gum arabic and alginic acid, and representative examples of semi-synthetic polymers are carboxymethyl cellulose, phthalated gelatin, sulfated starch, sulfated cellulose, ligninsulfonic acid, etc. Examples of the synthetic polymers are maleic anhydride-based copolymers (including hydrolyzates), acrylic acid-based polymers and copolymers (including methacrylic acid-based polymers and copolymers), vinylbenzenesulfonic acid-based polymers and copolymers, carboxy-modified polyvinyl alcohol, etc.

Examples of the nonionic polymer are polyvinyl alcohol, hydroxyethyl cellulose, methyl cellulose, etc.

An example of the amphoteric compound is gelatin, etc.

These water-soluble polymers are used in the form of from 0.01 to 10 wt% aqueous solution.

The organic solvent as used to dissolve the basic dye precursor preferably has a boiling point of not less than 180° C. because a low boiling point solvent is lost as a result of evaporation during storage. In this case, if an oil having at least two benzene rings and not containing a hetero atom and a double bond is used as the core oil, a rate of color formation during heat printing and a color density are increased. Moreover the formation of fog is decreased. Compounds of this type have features in that their capability to dissolve the basic dye precursor is excellent, they faciliate microcapsulation, and moreover in that they form color of high density upon instantaneous heating using a thermal head.

Organic solvents which can be used in the present invention include compounds represented by formulae (I) to (III) as described below, triarylmethanes (e.g., tritoluylmethane and toluyldiphenylmethane), terphenyl compounds (e.g., terphenyl), alkylated diphenyl ethers (e.g., propyldiphenyl ether), hydrogenated terphenyl (e.g., hexahydroterphenyl), diphenyl ether, etc.

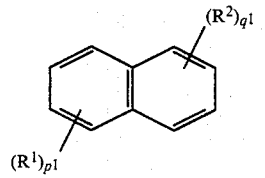

(I)

wherein $R^1$ is a hydrogen atom or an alkyl group having from 1 to 18 carbon atoms, $R^2$ is an alkyl group having from 1 to 18 carbon atoms, and $p^1$ and $q^1$ are each an integer of from 1 to 4, provided that the total number of alkyl groups is not more than 4. When $p^1$ is two or more, the $R^1$ groups can be the same as or different from one another. When $q^1$ is two or more, the $R^2$ groups can be the same as or different from one another.

The alkyl group represented by $R^1$ and $R^2$ preferably have from 1 to 8 carbon atoms.

(II)

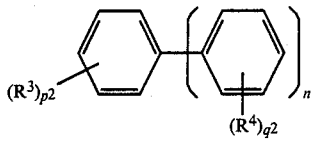

wherein $R^3$ is a hydrogen atom or an alkyl group having from 1 to 12 carbon atoms, $R^4$ is an alkyl group having from 1 to 12 carbon atoms, n is 1 or 2, and $p^2$ and $q^2$ are each an integer of from 1 to 4, provided that at least one alkyl group is contained, and when n is 1, the total number of alkyl groups is not more than 4 and when n is 2, the total number of alkyl groups is not more than 6. When $p^2$ is two or more, the $R^3$ groups can be the same as or different from one another. When $q^2$ is two or more, the $R^4$ groups can be the same as or different from one another.

(III)

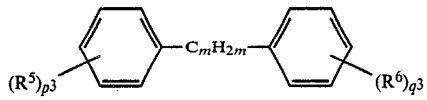

wherein $R^5$ and $R^6$ are each a hydrogen atom or an alkyl group having from 1 to 18 carbon atoms, provided that when $R^5$ and $R^6$ are both alkyl groups, the alkyl groups may be the same or different, m is an integer of from 1 to 13, and $p^3$ and $q^3$ are each an integer of from 1 to 3, provided that the total number of alkyl groups is not more than 3. When $p^3$ is two or more, the $R^5$ groups can be the same as or different from one another. When $q^3$ is two or more, the $R^6$ groups can be the same as or different from one another.

The alkyl group or groups represented by $R^5$ and $R^6$ preferably have from 2 to 4 carbon atoms.

Typical examples of the compounds represented by formula (I) are dimethylnaphthalene, diethylnaphthalene, and diisopropylnaphthalene.

Typical examples of the compounds represented by formula (II) are dimethylbiphenyl, diethylbiphenyl, diisopropylbiphenyl, and diisobutylbiphenyl.

Typical examples of the compounds represented by formula (III) are 1-methyl-1-dimethylphenyl-1-phenylmethane, 1-ethyl-1-dimethylphenyl-1-phenylmethane, and 1-propyl-1-dimethylphenyl-1-phenylmethane.

The above oils can be used as mixtures comprising two or more thereof, or in combination with other oils.

The basic dye precursor for use in the heat-sensitive recording material of the present invention is a compound forming color on donating an electron or receiving a proton, e.g., receiving a proton from an acid. Examples are shown below.

(1) Triarylmethane-base compounds such as 3,3-bis(p-dimethylaminophenyl)-6-dimethylaminophthalide (i.e., crystal violet lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, and 3-p-dimethylaminophenyl-3-(1-methylpyrole-2-yl)-6-dimethylaminophthalide.

(2) Diphenylmethane-base compounds such as 4,4'-bis-dimethylaminobenzhydrin benzyl ether, N-halophenyl leuco auramine, and N-2,4,5-trichlorophenyl leuco auramine.

(3) Xanthene-base compounds such rhodamine B-anilinolactam, rhodamine B-p-nitroanilinolactam, rhodamine B-p-chloroanilinolactam, 2-dimethylamino-7-methoxyfluorane, 2-diethylamino-7-methoxyfluorane, 3-diethylamino-7-methoxyfluorane, 3-diethylamino-7-chlorofluorane, 2-diethylamino-3-chloro-7-methylfluorane, 7-diethylamino-2,2-dimethylfluorane, 7-diethylamino-3-acetylmethylaminofluorane, 7-diethylamino-3-methylaminofluorane, 2-methyl-3-anilino-7-cyclohexl-N-methylaminofluorane, 2-chloro-3-anilino-7-diethylaminofluorane, 3-diethylamino-6-methyl-7-anilinofluorane, 3,7-diethylaminofluorane, 3-diethylamino-7-dibenzylaminofluorane, 3-diethylamino-7-methylbenzylaminofluorane, 3-diethylamino-7-chloroethylmethylaminofluorane and 3-diethylamino-7-diethylaminofluorane.

(4) Thiazine-base compounds such as benzoyl leuco methylene blue and p-nitrobenzoyl leuco methylene blue.

(5) Spiro compounds such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho(3-methoxybenzo)-spiro-pyran, and 3-propyl-spiro-dibenzopyran.

These compounds can be used alone or in combination with each other.

The basic dye precursor is determined appropriately depending on the purpose of use and desired properties. When, of the above compounds, triarylmethane-base leuco dyes and fluorane-base leuco dyes having the phthalide structure are used, the effect of the present invention is great. The most effective are black leuco dyes selected from fluoranes having an amino group or a substituted amino group in the 3 and 7 positions. It is generally suitable for these leuco dyes to be used in a concentration of from 5 to 20 wt% based on the weight of the organic solvent.

Developers which can be used for the above basic dye precursors include phenol compounds, organic acids, and their metal salts, and oxybenzoic acid esters, etc. In particular, preferably water-slightly-soluble phenols and organic acid having a melting point of from 50° to 250° C., and more preferably from 60° to 200° C., are desirable to use.

Examples of the above phenol compound include 4,4'-isopropylidene-diphenol (bisphenol A), p-tert-butylphenol, 2,4-dinitrophenol, 3,4-dichlorophenol, 4,4'-methylene-bis(2,6-di-tert-butylphenol), p-phenylphenol, 4,4-cyclohexylydenediphenol, 2,2'-methylenebis(4-tert-butylphenol), 2,2'-methylenebis(α-phenyl-p-cresol)thiodiphenol, 4,4'-thiobis(6-tert-butyl-m-cresol), sulfonyldiphenol, 1,1-bis(4-hydroxyphenyl)-n-dodecane, and ethyl 4,4-bis(4-hydroxyphenyl)-1-pentanate. In addition, a p-tert-butylphenol/formaldehyde condensate and a p-phenylphenol/formaldehyde condensate are included.

Useful examples of the organic acid or its metal salt include 3-di-tert-butylsalicylic acid, 3,5-tert-butylsalicylic acid, 5-α-methylbenzylsalicylic acid, 3,5-di-α-methylbenzylsalicylic acid, 3-tert-octylsalicylic acid, 5-α,γ-dimethyl-α-phenyl-γ-phenylpropylsalicylic acid, and zinc, lead, aluminum, magnesium, and nickel salts thereof.

Examples of the oxybenzoic acid ester include ethyl p-oxybenzoate, butyl p-oxybenzoate, heptyl p-oxybenzoate, and benzyl p-oxybenzoate.

These compounds are dispersed by the use, e.g., of a sand mill with a water-soluble polymer as a protective colloid and then applied. The amount of the basic dye precursor coated per unit area (1 $m^2$) is from 0.05 to 1.5 g and preferably from 0.1 to 0.5 g. The amount of the developer coated per unit area (1 $m^2$) is from 0.5 to 8 g and preferably from 0.5 to 4 g.

In the heat-sensitive recording material of the present invention, pigments such as silica, barium sulfate, titanium oxide, aluminum hydroxide, zinc oxide, and calcium carbonate, and fine powders of, e.g., styrene beads and a urea-melamine resin can be used for the purpose of preventing sticking or improving writing properties. Also, for the purpose of preventing sticking, metal soaps and the like can be used. The amount of the above substances for preventing sticking used is from 0.2 to 7 $g/m^2$.

In preparation of the heat-sensitive recording material of the present invention, a suitable binder can be used.

Binders which can be used include the emulsions of polyvinyl alcohol, methyl cellulose, carboxymethyl cellulose, hydroxypropyl cellulose, gum arabic, gelatin, polyvinyl pyrrolidone, casein, a styrene-butadiene latex, an acrylonitrile-butadiene latex, polyvinyl acetate, polyacrylate and an ethylene-vinyl acetate copolymer. The amount of the binder used is from 0.5 to 5 $g/m^2$ (solid basis).

In preparation of the heat-sensitive recording material of the present invention, a coating solution is coated on a support, e.g., paper and a synthetic resin film, by coating techniques such as bar coating, blade coating, air knife coating, gravure coating, roll coating, spray coating, and dip coating and then dried to from 2.5 to 25 $g/m^2$ (as solids) of a heat-sensitive layer.

As the paper to be used as the support, it is advantageous to use a neutral paper sized with a neutral sizing agent (e.g., an alkylketone dimer) and having a thermal extraction pH of 6 to 9 (as described in Japanese Patent Application (OPI) No. 14281/80, the term "OPI" as used herein means a "published unexamined Japanese patent application") because the neutral paper provides a recording material having excellent storage stability.

In order to prevent the permeation of the coating solution through the paper, and to improve the contact between the thermal head and the heat-sensitive recording layer, it is advantageous to use a paper meeting the following requirement:

$$\frac{\text{Stuckigt sizing degree}}{(\text{Meter basis weight})^2} \geqq 3 \times 10^{-3}$$

and having a Beck smoothness of not less than 90 seconds as described in U.S. Pat. No. 4,416,939. Stuckigt sizing degree conforms to JIS 8122 and is disclosed in more detail in U.S. Pat. No. 4,416,939.

In addition, paper having an optical surface roughness of not more than 8 μm and a thickness of from 40 to 75 μm (as described in Japanese Patent Application (OPI) No. 136492/83), paper as prepared from pulp which is bleached to such an extent that the Canadian standard freeness (as determined by JIS P 8121) is not less than 400 cc, and as treated so as to prevent permeation of the coating solution (as described in British Patent Application No. 2,112,155A), paper as described in U.S. Pat. No. 4,466,007 in which a lustrous surface of paper prepared with a Yankee machine is used as a coating surface to thereby improve the color density and resolving power, and paper as described in Japanese Patent Application (OPI) No. 136492/83 in which corona discharge treatment is applied to improve coating suitability, can be used with good results. Any other supports commonly used in the field of heat-sensitive recording papers can be used in the present invention.

The heat-sensitive recording material of the present invention is excellent in storage stability and heat color-forming properties.

The present invention is described below in greater detail by reference to the following examples although it is not intended to be limited thereto.

EXAMPLE 1

A mixture of 2.4 parts of 2-methyl-3-anilino-7-cyclohexyl-N-methylaminofluorane and 2.4 parts of 2-chloro-3-anilino-7-diethylaminofluorane as a basic dye precursor was dissolved in a mixed solvent of 24 parts of diisopropylnaphthalene and 15 parts of methylene chloride to prepare a solution forming a core substance. Then 18 parts of a xylylene diisocyanate/trimethylolpropane (3/1 mol ratio) adduct was added to and dissolved in the above solution. The resulting solution was mixed with a solution of 3.5 parts of polyvinyl alcohol, 1.7 parts of gelatin and 2.4 parts of 1,4-di(hydroxyethoxy)benzene in 58 parts of water and dispersed therein at 20° C. to prepare an emulsion having an average particle diameter of 3 μm. Then 100 parts of water was added to the emulsion, and the resulting mixture was heated to 60° C. while stirring. After 2 hours, a capsule solution containing the basic dye precursor in the core substance was obtained.

Twenty parts of bisphenol A was added to 100 parts of a 5% aqueous solution of polyvinyl alcohol and dispersed therein for about 24 hours by a sand mill to thereby prepare a dispersion of bisphenol A having an average size of 3 μm.

To 5 parts of the capsule solution was added 3 parts of the bisphenol A dispersion to prepare a coating solution.

The coating solution thus prepared was coated on a high quality paper (50 $g/m^2$) having a smooth surface in such an amount that the dry weight was 7 $g/m^2$, and then dried at 40° C. for 30 minutes to prepare a heat-sensitive recording material. The glass transition temperature of the capsule was 90° C.

COMPARATIVE EXAMPLE 1

A heat-sensitive recording material was produced in the same manner as in Example 1 except that a toluylene diisocyanate/trimethylolpropane (3/1 mol ratio) adduct was used in place of the xylylene diisocyanate/trimethylolpropane (3/1 mol ratio) adduct.

COMPARATIVE EXAMPLE 2

A heat-sensitive recording material was produced in the same manner as in Example 1 except that a hexamethylene diisocyanate/trimethylolpropane (3/1 mol ratio) adduct was used in place of the xylylene diisocyanate/trimethylolpropane (3/1 mol ratio) adduct.

Testing Method

In order to examine the storage stability of each heat-sensitive recording material, the material was stored under conditions of 40° C. and 90% RH for 3 days, and then the degree of formation of fog was measured on basis of a visual density. Before and after the storage under the above conditions, the material was printed with Mitsubishi Merafus 600 (facsimile device produced by Mitsubishi Electric Corp.) and changes in color-forming properties were measured. The results are shown in Table 1.

TABLE 1

| Sample | Fog | Color Density | Fog after Test | Color Density after Test |
|---|---|---|---|---|
| Example 1 | 0.09 | 1.18 | 0.11 | 1.17 |
| Comparative Example 1 | 0.14 | 1.16 | 0.27 | 1.01 |
| Comparative Example 2 | 0.19 | 1.20 | 0.43 | 1.05 |

By comparison of Example 1 with Comparative Examples 1 and 2, it can be seen that the recording material of the present invention is reduced in formation of fog both before and after the test as compared with the comparative materials, and that in the recording material of the present invention, reduction in the print density after the test is low.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support and a heat-sensitive recording layer on the support, said layer containing (1) microcapsules containing a basic dye precursor and an organic solvent as the core thereof and (2) a developer capable of forming color on reacting with the basic dye precursor, wherein said microcapsules are produced by the use of a wall-forming substance comprising xylylene diisocyanate or an adduct thereof such that the microcapsule walls are impermeable to both the basic dye precursor and developer at room temperature, but at a temperature of a thermal head during a recording process, become permeable to at least one of the basic dye precursor and developer, thereby permitting formation of a colored image as a result of the reaction between the basic dye precursor and the developer.

2. The heat-sensitive recording material as claimed in claim 1, wherein said wall-forming substance comprises a xylylene diisocyanate adduct having at least two equivalents of isocyanate group.

3. The heat-sensitive recording material as claimed in claim 2, wherein said xylylene diisocyanate adduct is an adduct of 3 mol of xylylene diisocyanate and 1 mol of trimethylolpropane.

4. The heat-sensitive recording material as claimed in claim 1, wherein said wall-forming substance further comprises a compound having at least two equivalents of an active group to the isocyanate group.

5. The heat-sensitive recording material as claimed in claim 4, wherein said compound is selected from the group consisting of a polyvalent hydroxy compound, an epoxy compound, a polyvalent thiol compound, a polyvalent amine compound, an acid anhydride compound an a polycarboxylic acid compound.

6. A heat sensitive recording material as claimed in claim 5, wherein the polyvalent hydroxy compound is selected from the group consisting of aliphatic and aromatic polyvalent alcohols, hydroxypolyesters, and hydroxypolyalkylene ethers.

7. A heat sensitive recording material as claimed in claim 5, wherein the polyvalent hydroxy compound is a hydroxypolyalkylene ether obtained using alkylene oxides exhibiting high lipophilic properties and having from 3 to 6 carbon atoms.

8. A heat sensitive recording material as claimed in claim 5, wherein the epoxy compounds are selected from the group consisting of aliphatic glycidyl ethers, aliphatic glycidyl esters and glycidyl ether/ester mixtures.

9. A heat sensitive recording material as claimed in claim 5, wherein the polyvalent thiol compounds are selected from the group consisting of thioglycol and condensates of thioglycol.

10. A heat sensitive recording material as claimed in claim 5, wherein the polyvalent amine compounds are selected from the group consisting of aromatic polyamines and aliphatic polyamines.

11. A heat sensitive recording material as claimed in claim 5, wherein the acid anhydride compound is selected from the group consisting of maleic anhydride, succinic anhydride, phthalic anhydride and benzoic anhydride.

12. A heat sensitive recording material as claimed in claim 5, wherein the polycarboxylic acid compound is selected from the group consisting of malonic acid, succinic acid, glutaric acid, adipic acid, pimelic acid, maleic acid, isophthalic acid, terephthalic acid and gluconic acid.

13. The heat-sensitive recording material as claimed in claim 4, wherein said wall-forming substance is in the form of prepolymer.

14. The heat-sensitive recording material as claimed in claim 1, wherein the walls of said microcapsules have a glass transition point of from 60° to 200° C.

15. The heat-sensitive recording material as claimed in claim 14, wherein the walls of said microcapsules have a glass transition point of from 70° to 150° C.

16. The heat-sensitive recording material as claimed in claim 1, wherein said organic solvent has a boiling point of 180° C. or more.

17. The heat-sensitive recording material as claimed in claim 1, wherein said basic dye precursor is a triarylmethane-base leuco dye or a fluorane-base leuco dye having a phthalide structure.

18. The heat-sensitive recording material as claimed in claim 17, wherein said basic dye precursor is a black leuco dye selected from fluoranes having an amino group or a substituted amino group in the 3 and 7 positions.

19. The heat-sensitive recording material as claimed in claim 17, wherein said basic dye precursor is used in a concentration of from 5 to 20 wt% based on the weight of the organic solvent.

20. The heat-sensitive recording material as claimed in claim 1, wherein the amount of said basic dye precursor coated on 1 $m^2$ of the support is in the range of from 0.05 to 1.5 g.

21. The heat-sensitive recording material as claimed in claim 20, wherein the amount of said basic dye precursor coated on 1 $m^2$ of the support is in the range of from 0.1 to 0.5 g.

22. The heat-sensitive recording material as claimed in claim 1, wherein said developer is a water-slightly-soluble phenol or organic acid having a melting point of from 50° to 250° C.

23. The heat-sensitive recording material as claimed in claim 22, wherein said developer is a water-slightly-soluble phenol or organic acid having a melting point of from 60° to 200° C.

24. The heat-sensitive recording material as claimed in claim 1, wherein the amount of said developer coated on 1 $m^2$ of the support is in the range of from 0.5 to 8 g.

25. The heat-sensitive recording material as claimed in claim 24, wherein the amount of said developer coated on 1 $m^2$ of the support is in the range of from 0.5 to 4 g.

* * * * *